US009276325B2

(12) United States Patent
Sim

(10) Patent No.: US 9,276,325 B2
(45) Date of Patent: Mar. 1, 2016

(54) ELECTROMAGNETIC WAVE REVERBERATION CHAMBER

(75) Inventor: Dong-Uk Sim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 560 days.

(21) Appl. No.: 13/590,607

(22) Filed: Aug. 21, 2012

(65) Prior Publication Data

US 2013/0050006 A1 Feb. 28, 2013

(30) Foreign Application Priority Data

Aug. 22, 2011 (KR) ..... 10-2011-0083219

(51) Int. Cl.
*H01Q 17/00* (2006.01)

(52) U.S. Cl.
CPC ..... *H01Q 17/00* (2013.01); *H01Q 17/008* (2013.01)

(58) Field of Classification Search
CPC ..... H01Q 17/00; H01Q 17/008
USPC ..... 342/1–4
See application file for complete search history.

(56) References Cited

U.S. PATENT DOCUMENTS

| | | | | |
|---|---|---|---|---|
| RE33,505 | E * | 12/1990 | Vinegar et al. | 324/320 |
| 5,243,126 | A * | 9/1993 | Chow et al. | 174/388 |
| 6,344,255 | B1 * | 2/2002 | Murase et al. | 428/116 |
| 6,407,693 | B1 * | 6/2002 | Murase et al. | 342/4 |
| 6,538,596 | B1 | 3/2003 | Gilbert | |
| 8,693,158 | B2 * | 4/2014 | Chew | G01R 29/0821 324/636 |
| 9,035,817 | B2 * | 5/2015 | Sim | H01Q 17/008 342/1 |
| 2008/0129453 | A1 * | 6/2008 | Shanks et al. | 340/10.1 |
| 2011/0133978 | A1 | 6/2011 | Sim | |
| 2011/0147063 | A1 * | 6/2011 | Kwon et al. | 174/260 |
| 2013/0050006 | A1 * | 2/2013 | Sim | H01Q 17/008 342/4 |

FOREIGN PATENT DOCUMENTS

| | | | |
|---|---|---|---|
| CA | 2352133 | A1 * | 6/2000 |
| EP | 2256507 | A1 * | 12/2010 |
| KR | 1020110064028 | A | 6/2011 |

OTHER PUBLICATIONS

Benson, T.M., "Application to test chamber problems," EMC-Fundamentals, IEE Colloquium on , vol., no., pp. 4/1,4/5, Mar. 18, 1996.*
Leferink, F., "In-situ high field strength testing using a transportable reverberation chamber," Electromagnetic Compatibility and 19th International Zurich Symposium on Electromagnetic Compatibility, 2008. APEMC 2008. Asia-Pacific Symposium on, vol., no., pp. 379,382, May 19-23, 2008.*

(Continued)

*Primary Examiner* — John B Sotomayor
(74) *Attorney, Agent, or Firm* — Ladas & Parry LLP

(57) ABSTRACT

An electromagnetic wave reverberation chamber formed in the shape of a polyhedron includes an electromagnetic wave absorbing apparatus installed on at least one wall of metal conductors of the electromagnetic wave reverberation chamber. The electromagnetic wave absorbing apparatus having a shape of a roll screen and includes an electromagnetic wave absorbing film, a roll for rolling the one end of the electromagnetic wave absorbing film, a cover for covering the roll, and a fixing unit for fixing the other end of the electromagnetic wave absorbing film.

20 Claims, 9 Drawing Sheets

(56) References Cited

OTHER PUBLICATIONS

D.J. Kern, et al; "A Genetic Algorithm Approach To The Design of Ultra-Thin Electromagnetic Bandgap Absorbers", Microwave and Optical Technology Letters; vol. 38, No. 1, Jul. 5, 2003, pp. 61-64.

Olof Lundén, et al; "Absorber Loading Study in FOI 36.7 $m^3$ Mode Stirred Reverberation Chamber for Pulsed Power Measurements", EMC 2008 IEEE International Symposium on Electromagnetic Compatibility, pp. 1-5; Aug. 18-22, 2008.

Q. Gao, et al; "Application of metamaterials to ultra-thin radar-absorbing material design", Electronics Letters, Aug. 18, 2005, vol. 41, No. 17, 2 pages.

Jung-Hwan Choi, et al; "Generation of Rayleigh/Rician Fading Channels With Variable RMS Delay by Changing Boundary Conditions of the Reverberation Chamber", IEEE Antennas and Wireless Propagation Letters, vol. 9; pp. 510-513; Jun. 10, 2010.

* cited by examiner

ELECTROMAGNETIC WAVE REVERBERATION CHAMBER

CROSS-REFERENCE TO RELATED APPLICATION(S)

The present invention claims priority of Korean Patent Application No. 10-2011-0083219, filed on Aug. 22, 2011, which is incorporated herein by reference.

FIELD OF THE INVENTION

The present invention relates to an electromagnetic wave reverberation chamber; and more particularly, to an electromagnetic wave reverberation chamber including an electromagnetic wave absorbing apparatus to which a periodic structure technology such as an electromagnetic bandgap (EBG) is applied.

BACKGROUND OF THE INVENTION

As information technology is developed rapidly and a desire for the communication of a human being is increased, mobile communication devices such as a portable device are necessities of a contemporary man. However, the effect of the electromagnetic wave generated by the device to a human body has been an important issue as the use of the portable device is increased. At present, a relation between the electromagnetic wave in a frequency bandwidth used in a cellular phone and the effect of the electromagnetic wave to the human body has not been disclosed clearly. However, it has been being reported that the electromagnetic can affect various diseases such as a leukemia, an encephaloma, a headache, a decreased visual acuity, a brain wave disorder when the electromagnetic wave is accumulated in the human body, the damage of the reproduction ability of a man, etc.

In addition, a malfunction between information communication devices due to undesirable electromagnetic wave is constantly reported. This is an electromagnetic interference/electromagnetic compatibility (EMI/EMC) problem. Thus, the measurement method and the acceptable standard of the unwanted frequency of an electrical and an electronic communication device are prescribed in order to prevent interference between the devices due to the unwanted frequency. Moreover, the EMC should be considered at the stage of design and manufacture to satisfy the method and the standard and the EMC test should be satisfied for selling a product.

An electromagnetic wave reverberation chamber as an experiment facility for measuring the EMI and a radiation tolerance has been reported as the experiment result of a national institute standards and technology (NIST) and an international special committee on Radio interference (CISPR) prescribed specifications for the electromagnetic wave reverberation chamber in a IEC 61000-4-21.

The electromagnetic wave reverberation chamber is a measuring chamber of which all inner walls do not absorb the electromagnetic wave so that the electromagnetic wave has optimal reverberation time and diffusivity in the chamber in contrast to an anechoic chamber. Thus, the electromagnetic wave anechoic chamber should absorb electromagnetic wave fully by using an electromagnetic wave absorber installed on the all inner walls of the electromagnetic wave anechoic chamber. However, the electromagnetic wave reverberation chamber does not need the absorber because the all inner walls of the chamber should reflect the electromagnetic wave fully. Instead, the electromagnetic wave reverberation chamber is generally manufactured by installing a metal wall on the inner wall thereof.

The conventional electromagnetic anechoic chamber provides a non-reflection environment and thus can evaluate performance of a target device without being affected by a peripheral communication environment. However, this cannot accurately evaluate the performance of the target device in the real environment. This is because, in the real environment, various communication services are provided, and the target device is used in a multi-reflection environment due to various reflectors. For that reason, there is required a technique capable of measuring and evaluating the target device in a facility close to the real environment. As for a method for creating a multi-reflection environment in the conventional large electromagnetic anechoic chamber, there was suggested a technique for performing measurement and evaluation by adding an apparatus capable of generating various channel sources. However, such apparatus requires a considerably high cost, and a large facility such as an electromagnetic wave anechoic chamber is still required. Therefore, there is required a measurement apparatus capable of solving a high-price software-based device in a hardware manner and realizing it in a small size and at a low cost. Accordingly, an electromagnetic wave reverberation chamber is proposed in IEC 61000-4-21 standard. The electromagnetic wave reverberation chamber can be manufactured in a considerably smaller size compared to the electromagnetic anechoic chamber, and does not require an additional high-price apparatus. In addition, the electromagnetic wave reverberation chamber can provide a measurement environment similar to the real environment where the target device is used.

The electromagnetic wave reverberation chamber obtains the uniformity of the electric field by using a stirrer in order to lower lowest usable high frequency (LUF). The uniformity of the electric field can be determined by a total number of modes which can be generated in the electromagnetic wave reverberation chamber, Q-factor of the medium used for manufacturing the electromagnetic wave reverberation chamber and the efficiency of the stirrer, etc.

Meanwhile, a technology improving the performance of the electromagnetic wave reverberation chamber by using the electromagnetic wave absorber has been reported.

Meanwhile, there is recently proposed a technique for improving the performance of the electromagnetic wave reverberation chamber by using a material based electromagnetic wave absorber other than an element for determining the performance of the electromagnetic wave reverberation chamber.

This technique can emulate various reflection environments by controlling reflection characteristics of the electromagnetic wave in the electromagnetic wave reverberation chamber by using the electromagnetic wave absorber installed in a certain space in the electromagnetic wave reverberation chamber.

FIG. 1 shows an outer shape of a conventional electromagnetic wave reverberation chamber and FIG. 2 depicts an inner shape of a conventional electromagnetic wave reverberation chamber.

As shown in FIGS. 1 and 2, the electromagnetic wave reverberation chamber can be manufactured in the shape of a polyhedron. The electromagnetic wave reverberation chamber has the shape of a cube generally. All the inner wall of the chamber consists of a metal conductor for the total reflection of the electromagnetic wave, and the stirrer and a pyramidal electromagnetic wave absorber are installed in the intended space for controlling the reflection characteristic of the inside of the chamber. The pyramidal electromagnetic wave absorber improves the reflection characteristic of the inside of the chamber so that more uniform electrical field distribution can be obtained. The position, size and electromagnetic field absorption rate of the pyramidal electromagnetic wave absorber affects the total performance of the chamber.

However, the conventional pyramidal electromagnetic wave absorber is not suitable for a device to be tested since the size of the conventional pyramidal electromagnetic wave absorber is so large that the inside space of the chamber can be small. In this case, since the electromagnetic wave reverberation chamber should be manufactured to be larger, there exist problems that the manufacture cost of the electromagnetic wave reverberation chamber is raised and an installation space for the chamber should be larger.

In addition, since the conventional pyramidal electromagnetic wave absorber is manufactured by using a material having absorption characteristic and is developed by a trial and error method, there exist considerable problems that the manufacturing process of the absorber is complicated and it is difficult to adjust the absorption characteristic and an absorption frequency bandwidth.

Meanwhile, as the additional examples of the conventional electromagnetic wave absorber, there is a $4/\lambda$ type wave absorber or a flat-plate type resonant absorber such as a Salisbury screen.

The construction of the resonant absorber is simple since the resonant absorber consists of a resistive film, a dielectric spacer and a metal conductor ground surface. Thus, the resonant absorber can be manufactured easily and the absorption performance thereof can be easily adjusted. In addition, when the resonant absorber is manufactured in a multilayer form, a multiple bandwidth absorption characteristic can be obtained.

However, the conventional resonant absorber has a problem that the thickness of the dielectric spacer needs to be equal to or larger than $4/\lambda$ from the metal conductor ground surface.

Meanwhile, various reflection environments can be created in accordance with the installation position and the area of the electromagnetic wave absorber, so that the electromagnetic wave absorber of a desired size needs to be easily attached to and detached from any wall. In other word, since all inner walls of the electromagnetic wave reverberation chamber are made of metal conductors, the electromagnetic wave absorber needs to be easily installed at a desired location such that additional options can be added while maintaining the performance of the reverberation chamber.

However, the material based absorber is not easily attached to the wall of the electromagnetic wave reverberation chamber, and it is difficult to install the material based absorber having a desired area. Further, the absorption performance of the material based absorber is changed in accordance with temperature and humidity. Hence, the material based absorber is highly sensitive to the environment variation and may be harmful to human.

SUMMARY OF THE INVENTION

In view of the above, the present invention provides an electromagnetic wave reverberation chamber including a small and thin electromagnetic wave absorbing apparatus to which a periodic structure such as an electromagnetic bandgap is applied.

Further, the present invention provides an electromagnetic wave reverberation chamber including an easily manufacturable electromagnetic wave absorbing structure having one surface made of a metal conductor, wherein a thickness of the electromagnetic wave absorbing structure can be reduced by using a periodic structure technique such as an electromagnetic bandgap structure, and the absorbing frequency band and the absorbing feature can be easily controlled by controlling parameters.

Embodiment of the present invention relates to an electromagnetic wave reverberation chamber including a small and thin electromagnetic wave absorbing apparatus to which a periodic structure such as an electromagnetic bandgap is applied.

In the embodiment, an electromagnetic wave reverberation chamber formed in the shape of a polyhedron, each surface being made of a metal conductor, which includes wherein an electromagnetic wave absorbing apparatus which is installed on at least one surface of the metal conductors of the electromagnetic wave reverberation chamber, the electromagnetic wave absorbing apparatus having a shape of a roll screen.

In the embodiment, the electromagnetic wave absorbing apparatus includes: an electromagnetic wave absorbing film; a roll for rolling the one end of the electromagnetic wave absorbing film; a cover for covering the roll; and a fixing unit for fixing the other end of the electromagnetic wave absorbing film.

In the embodiment, the electromagnetic wave absorbing film is formed by screen-printing the electromagnetic wave bandgap pattern layer on a transparent film.

In the embodiment, the transparent film is made of PET (Poly Ethylene Terephthalate).

In the embodiment, the electromagnetic wave absorbing apparatus includes a plurality of unit cells arranged periodically. Each of the unit cells includes: a metal conductor layer; a dielectric layer formed on the metal conductor layer; and a unit cell pattern formed on the dielectric layer, the unit cell pattern being made of a resistive material.

In the embodiment, the electromagnetic wave absorbing apparatus includes a plurality of unit cells arranged periodically. Each of the unit cells has a metal conductor layer; a dielectric layer formed on the metal conductor layer; a unit cell pattern formed on the dielectric layer, the unit cell pattern being made of a resistive material; and a resistive film formed on the unit cell pattern.

In the embodiment, the unit cell pattern has at least one shape of polygon, circle and loop.

In the embodiment, the unit cell patterns adjacent to each other in the unit cells arranged periodically have with a different surface resistance value.

In the embodiment, the unit cell patterns adjacent to each other in the unit cells arranged periodically are arranged in alternate fashion to have at least one of resistances and structures different from each other.

In the embodiment, the unit cell pattern includes: a basic patch which is located in a center of the unit cell pattern, the basic patch having a quadrangle shape whose center of each side is cut by a quadrangle; and a semi-orthogonal dipole patch arranged to be engaged in each center of an upper side, a bottom side, a left side and a right side of the basic patch at a predetermined gap and angle, wherein a resonance frequency and a band of the electromagnetic wave absorbing apparatus are controlled by adjusting at least one of a structure parameter determining an electrical distance between the basic patch and the semi-orthogonal dipole patch, a spacing between the basic patch and the semi-orthogonal dipole patch, a height from the metal conductor layer to the unit cell pattern, a material characteristic of the dielectric layer, and a surface resistance of the unit cell pattern.

In the embodiment, the basic patch includes a first slot of a quadrangle formed in a center thereof, wherein a resonance frequency and a band of the electromagnetic wave absorbing apparatus are controlled by adjusting at least one of a structure parameter determining an electrical distance between the basic patch and the semi-orthogonal dipole patch, a spacing between the basic patch and the semi-orthogonal dipole patch, a height from the metal conductor layer to the unit cell pattern, a material characteristic of the dielectric layer, a surface resistance of the unit cell pattern, and a size of the first slot.

In the embodiment, the basic patch includes a second slot of a quadrangle formed in each corner of the first slot on the basic patch, wherein a resonance frequency and a band of the electromagnetic wave absorbing apparatus are controlled by adjusting at least one of a structure parameter determining an electrical distance between the basic patch and the semi-orthogonal dipole patch, a spacing between the basic patch and the semi-orthogonal dipole patch, a height from the metal conductor layer to the unit cell pattern, a material characteristic of the dielectric layer, a surface resistance of the unit cell pattern, a size of the first slot, and length of one side of the second slot.

In the embodiment, the basic patch and the semi-orthogonal dipole patch have a different surface resistance value.

In the embodiment, the structure parameter includes at least one of a length of one side of the unit cell pattern, a length of a side of the semi-orthogonal dipole patch coming into contact with the unit cell pattern, a length of a side parallel to the basic patch among sides of the semi-orthogonal dipole patch being coupled with the basic patch, a length of the one side of the quadrangle of the basic patch, a thickness of the unit cell, and a height perpendicular to the one side of the unit cell pattern in the semi-orthogonal dipole patch.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Figure 1:
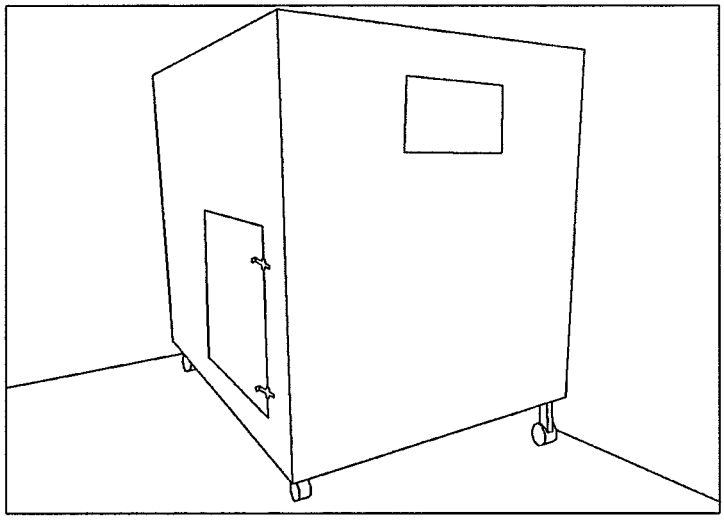
FIG. 1 (PRIOR ART)
FIG. 1 shows an outer shape of a conventional electromagnetic wave reverberation chamber.

The embodiment of the present invention relates to an electromagnetic wave reverberation chamber, and more particularly to an electromagnetic wave reverberation chamber including an easily manufacturable electromagnetic wave absorbing structure having one surface made of a metal conductor, wherein a thickness of the electromagnetic wave absorbing structure can be reduced by using a periodic structure technique such as an electromagnetic bandgap structure, and the absorbing frequency band and the absorbing feature can be easily controlled by controlling parameters.

Particularly, the electromagnetic wave reverberation chamber having the electromagnetic wave absorbing apparatus capable of easily controlling the absorption area can be realized by manufacturing the electromagnetic wave bandgap pattern layer of the electromagnetic wave absorbing structure in the form of a roll screen and installing it at the inner wall of the electromagnetic wave reverberation chamber which is made of a metal conductor.

The present invention provides an electromagnetic wave reverberation chamber having a thin type electromagnetic wave absorbing apparatus that is realized by a periodic structure technique such as an electromagnetic wave bandgap. The electromagnetic bandgap as a technique of employing a periodic structure may be implemented by periodically arranging specifically designed unit cell patterns on a typical electric conductor at regular intervals. Since a tangential component of a magnetic field at a particular band on the surface of the electromagnetic bandgap becomes zero, the electromagnetic bandgap has the characteristic of preventing current from flowing through the surface. Such an electromagnetic bandgap may be regarded as a magnetic conductor opposite to the typical electric conductor. The surface of the electromagnetic bandgap is a high-impedance surface (HIS) in configuration of a circuit.

The frequency response characteristics of the electromagnetic bandgap may be checked through a reflection phase which refers to a difference between the phases of an incident wave on the surface of the electromagnetic bandgap and a reflected wave from the surface. The reflection phase of the electromagnetic bandgap becomes zero at a resonant frequency corresponding to a high impedance surface and varies in a range from −180 degrees to 180 degrees in a frequency band around the resonant frequency. When the structural parameters of the electromagnetic bandgap are adjusted, the reflection phase may vary.

In the structure of a typical electromagnetic bandgap, a dielectric layer and an array layer of unit cell patterns other than a metal conductive ground plane constitute the typical structure of a frequency selective surface (FSS). FSS is a surface formed by artificially and periodically arranging specific unit cell patterns so as to selectively transmit or reflect desired frequencies. Therefore, an electromagnetic bandgap not only completely blocks the progression of electromagnetic waves but also has the above-described unique physical characteristics, by virtue of providing a metal conductive ground plane for the characteristics of filtering of a specific frequency due to the FSS.

Meanwhile, when this FSS is applied to a plate-type resonant electromagnetic wave absorber, a thickness and absorption performance of the electromagnetic wave absorber are able to be controlled owing to the inherent electromagnetic properties of the FSS. That is, in the resonant electromagnetic wave absorber composed of a resistive film, a dielectric spacer and a metal conductive ground plane, the FSS is interposed between the dielectric spacer and the resistive film. The electromagnetic wave absorber formed in this way has a structure formed by adding a resistive coating to the typical structure of the EBG. Furthermore, when the unit cell patterns of the EBG are designed and made of a resistive material on a metal conductor, such a resistive EBG itself may function as a simpler electromagnetic wave absorber.

Such an electromagnetic wave absorber may be applied to fields where existing electromagnetic wave absorbers have been applied in order to reduce the multiple reflection of electromagnetic waves, as a simpler structure that is easily manufactured and has low cost. In particular, since the absorption frequency band of the electromagnetic wave absorber can be adjusted only by a simple structural or material deformation of the unit cell thereof, the electromagnetic wave absorber can selectively absorb the electromagnetic waves of a desired frequency band, so that this electromagnetic wave absorber can be very usefully used under the condition that electromagnetic waves of various frequency bands coexist. Further, since a bottom side of the electromagnetic wave absorber is made of a metal conductor, when there is a need to attach the electromagnetic wave absorber to another metal conductor, it can be directly used without changing its performance.

Meanwhile, all inner walls of the electromagnetic reverberation chamber are made of a metal conductor and, thus, the resistive electromagnetic wave bandgap absorbing structure is obtained by installing the resistive electromagnetic wave bandgap pattern on the metal conductor with a predetermined gap therebetween.

In the present embodiment, in order to effectively install the electromagnetic wave absorbing apparatus based on the electromagnetic wave bandgap in the electromagnetic wave reverberation chamber, the resistive electromagnetic wave bandgap pattern is screen-printed on a general PET (Poly Ethylene Terephthalate) film. Further, the electromagnetic wave absorbing apparatus is manufactured in the form of a roll screen having a controllable thickness and detachably attached to the wall of the reverberation chamber. Hence, the problems of the reverberation chamber using the material based absorber can be completely solved.

Moreover, a user can determine the width and length of the roll screen to control the area of the wall used for the electromagnetic wave absorbing structure. This indicates that various reflection environments in the electromagnetic wave reverberation chamber can be controlled in a hardware manner by controlling the width and the length of the roll screen type electromagnetic wave absorbing apparatus.

Hereinafter, embodiments of the present invention will be described with reference to the accompanying drawings which form a part hereof.

Figure 3:
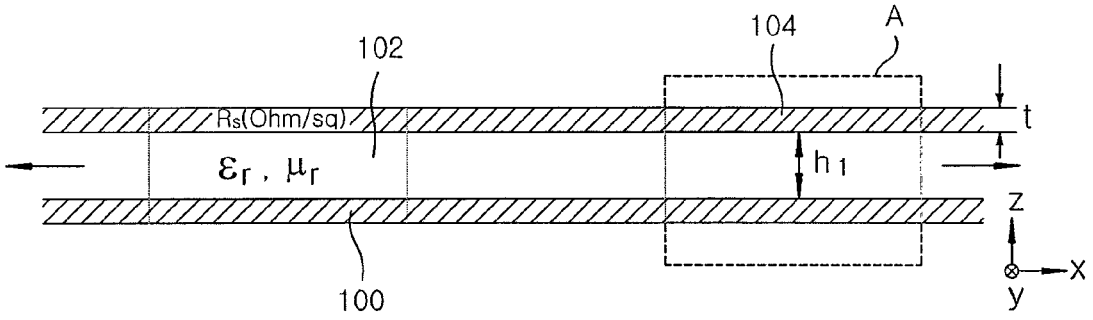
FIG. 3 illustrates an electromagnetic wave absorbing apparatus included in an electromagnetic wave reverberation chamber in accordance with an embodiment of the present invention.

FIG. 3 illustrates an electromagnetic wave absorbing apparatus included in an electromagnetic wave reverberation chamber in accordance with an embodiment of the present invention.

As shown in FIG. 3, the electromagnetic wave absorbing apparatus includes a plurality of a 'A' arranged periodically. The unit cell 'A' includes a metal conductor layer 100, a dielectric layer 102 formed on the metal conductor layer 100, a unit cell pattern 104 of a resistive material formed on the dielectric layer 102. For example, the unit cell pattern 104 may be substituted by a unit cell pattern of a metal material and a resistive film formed on the unit cell pattern.

The unit cell 'A' including the dielectric layer 102 and the unit cell pattern 104 of the resistive material is a structure where a loss is added to a frequency selective surface. An incident wave may be partially reflected by the unit cell A and the incident wave may penetrate partially the unit cell A in a desired frequency. A phase in the dielectric may be adjusted by the unit cell 'A'. In addition, the conductor layer 100 totally reflects an electromagnetic wave penetrating partially the unit cell 'A'. Eventually, an absorption frequency is determined by the capacitance 'C' and the inductance 'L' of the unit cell pattern 104 from the height of the dielectric layer 102 as an electromagnetic bandgap shape. The height of the dielectric layer 102 is formed more lower than $\lambda/4$, i.e., a height needed for absorption, by the reflection phase characteristic of the electromagnetic bandgap so that the electromagnetic wave penetrating partially the unit cell pattern A can be attenuated.

A height '$h_1$' from the metal conductor layer 100 to the unit cell pattern 104, dielectric characteristics '$\in_r$' and '$\mu_r$' and the thickness 't' of the unit cell pattern functions as parameters for an absorption performance so that the absorption bandwidth and the absorption performance of the electromagnetic wave may be adjusted. Here, the same design parameters may be differently adjusted in each direction and in this case, electromagnetic waves in the different frequency bandwidths may be absorbed at the same time in both directions.

Figure 2:
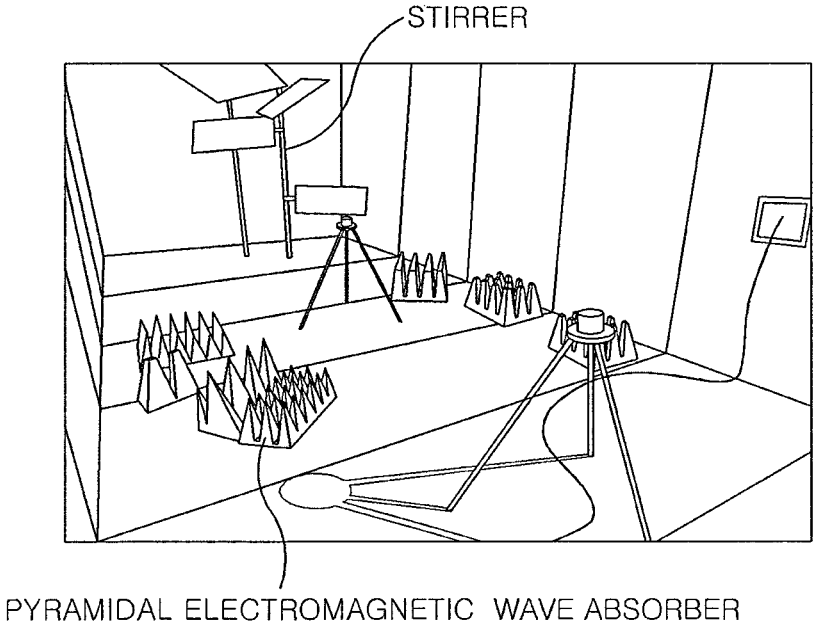
FIG. 2 (PRIOR ART)
FIG. 2 depicts an inner shape of an electromagnetic wave reverberation chamber including a conventional pyramidal electromagnetic wave absorber.

The electromagnetic wave reverberation chamber in accordance with an embodiment of the present invention may manufactured by substituting the electromagnetic wave absorbing apparatus in accordance with the embodiment of the present invention for the conventional pyramidal electromagnetic wave absorber in the electromagnetic wave reverberation chamber of FIGS. 1 and 2.

The electromagnetic wave absorbing apparatus with a metal conductor at its one side surface is installed in the intended space inside the electromagnetic wave reverberation chamber in accordance with an embodiment of the present invention and the electromagnetic wave absorbing apparatus has an electromagnetic bandgap structure.

The electromagnetic wave reverberation chamber has a polyhedron shape (e.g., a cube shape) and all inner walls of the electromagnetic wave reverberation chamber are made of a metal conductor for the total reflection. The stirrer and the electromagnetic wave absorbing apparatus in accordance with an embodiment of the present invention are installed in an intended space in order to adjust the reflection characteristics, wherein the absorption area can be easily controlled by manufacturing the electromagnetic wave bandgap pattern layer of electromagnetic wave absorbing structure in the form of a roll screen and installing it at the inner wall of the electromagnetic wave reverberation chamber which is made of a metal conductor.

Here, the stirrer is selectively installed when it is needed to form a uniform field of the inside of the electromagnetic wave reverberation chamber. Thus, the stirrer may be excluded.

Figure 4:
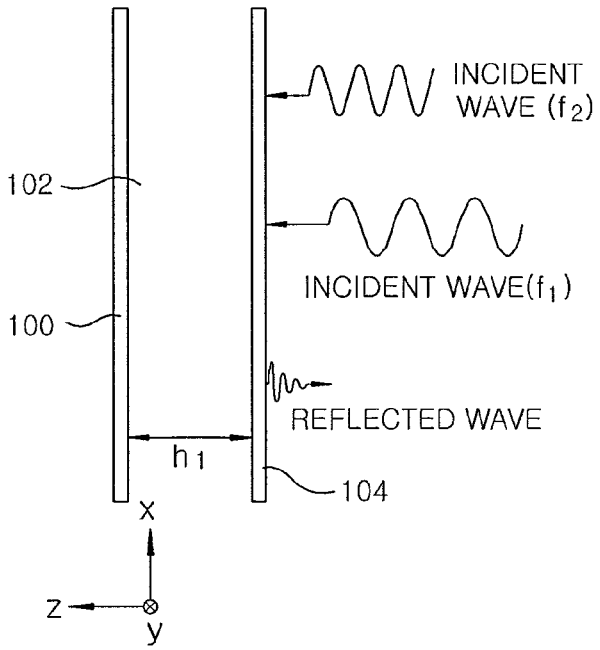
FIG. 4 shows a concept of an electromagnetic wave absorption by an electromagnetic wave absorbing apparatus included in an electromagnetic wave reverberation chamber in accordance with an embodiment of the present invention.

FIG. 4 illustrates a concept of an electromagnetic wave absorption by an electromagnetic wave absorbing apparatus included in an electromagnetic wave reverberation chamber in accordance with an embodiment of the present invention. In FIG. 4, an absorption performance that a reflection wave is rarely shown when electromagnetic waves of various frequency bands are incident on the electromagnetic wave absorbing apparatus is illustrated.

Figure 5A:
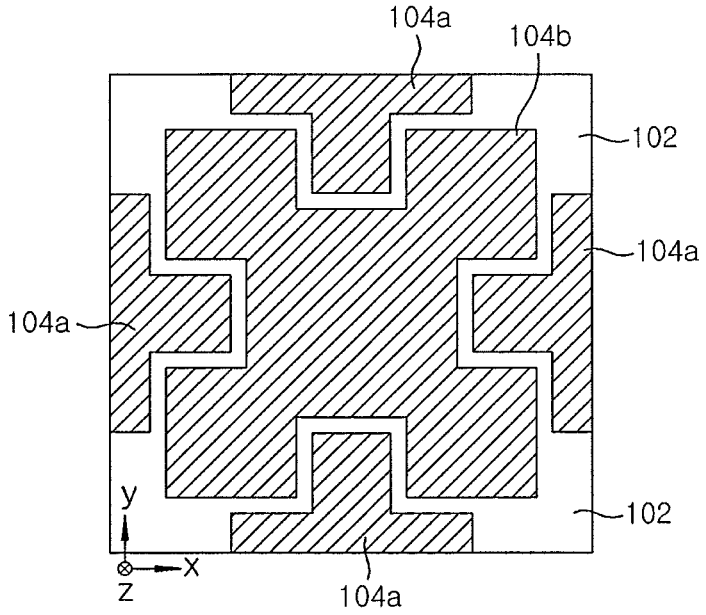
FIGS. 5A and 5B illustrate a structure of a unit cell pattern and a design parameter applicable to an electromagnetic wave absorbing apparatus in an electromagnetic wave reverberation chamber in accordance with the embodiment of the present invention.
Figure 5B:
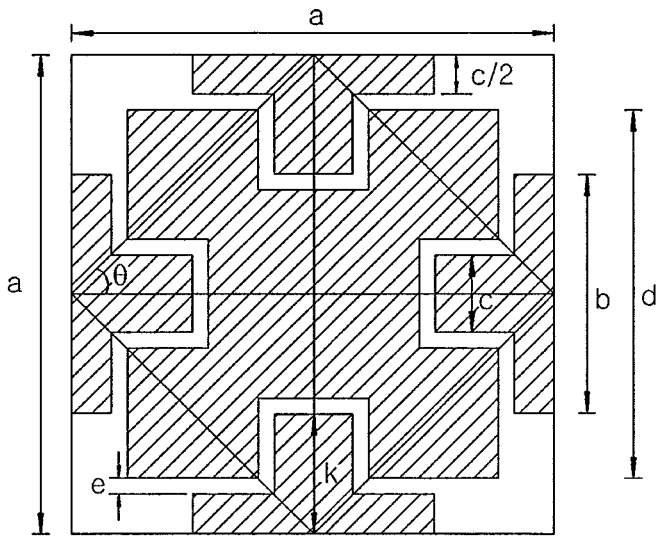

FIGS. 5A and 5B show a structure of a unit cell pattern and a design parameter applicable to an electromagnetic wave absorbing apparatus in accordance with the embodiment of the present invention.

Referring to FIGS. 5A and 5B, the unit cell pattern includes a basic patch 104*b* located in the center of the unit cell pattern. The shape of the basic patch 104*b* is a quadrangle whose center of each side is cut by a quadrangle. In addition, the unit cell pattern includes a semi-orthogonal dipole patch 104*a*. The semi-orthogonal dipole patch 104*a* is arranged to be engaged in each center of the upper side, the bottom side, the left side, the right side of the basic patch 104*b* at a predetermined gap and angle.

The resonance frequency and the band of the electromagnetic wave absorbing apparatus may be adjusted by controlling at least one of a structure parameter determining the electrical distance between the basic patch 104*b* and the semi-orthogonal dipole patch 104*a*, a spacing between the basic patch 104*b* and the semi-orthogonal dipole patch 104*a*, a height from the metal conductor layer to the unit cell pattern, the material characteristic of the dielectric layer, and the surface resistance of the unit cell pattern. For example, each of the basic patch 104*b* and the semi-orthogonal dipole patch 104*a* may be adjusted to have a different a surface resistance.

Here, the structure parameter determining the electrical distance between the basic patch 104*b* and the semi-orthogonal dipole patch 104*a* includes a length of the one side of the unit cell pattern, a length of the side of the semi-orthogonal dipole patch 104*a* coming into contact with the unit cell pattern, a length of a side parallel to the basic patch 104*b* among sides of the semi-orthogonal dipole patch being coupled with the basic patch, a length of the one side of the quadrangle of the basic patch 104*b*, a thickness of the unit cell, and a height perpendicular to the one side of the unit cell pattern in the semi-orthogonal dipole patch 104*a*.

Figure 6:
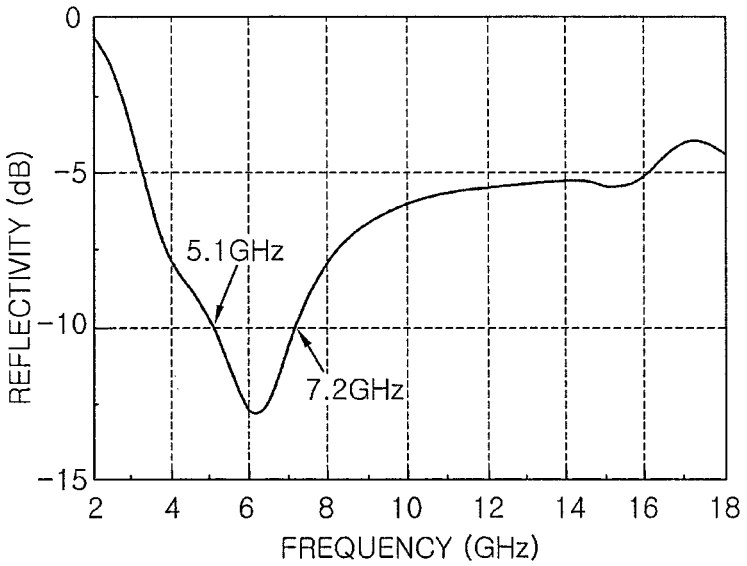
FIG. 6 depicts an absorption performance and an absorption band of an electromagnetic wave absorbing apparatus having the unit cell pattern structure shown in FIGS. 5A and 5B.

FIG. 6 depicts an absorption performance and an absorption band when the structure parameter values of the unit cell pattern are Rs=40 Ohm/sq, a=30 mm, b=15 mm, c=5 mm, d=23 mm, e=1 mm, h=4.7 mm, k=7.5 mm, t=0.001 mm, $\theta=45°$, $\in_r=1$ and $\mu_r=1$. A reflectivity expressing the absorption performance can be defined in the following Mathematical Expression 1

$$R(dB)=20\times\log(r_{DUT}/r_G) \quad (1)$$

where R, $r_{DUT}$ and $r_G$ mean the reflectivity, the reflection coefficient of the electromagnetic wave absorbing apparatus and the reflection coefficient of the surface of the metal conductor layer, respectively. The reflectivity of −10 dB means that the 90% of the incident electromagnetic wave is absorbed. The frequency band having a reflectivity equal to or lower than −10 dB of a base line is from 5.1 GHz to 7.2 GHz. Thus, a frequency band according to the embodiment of the present invention is from 5.1 GHz to 7.2 GHz.

Figure 7:
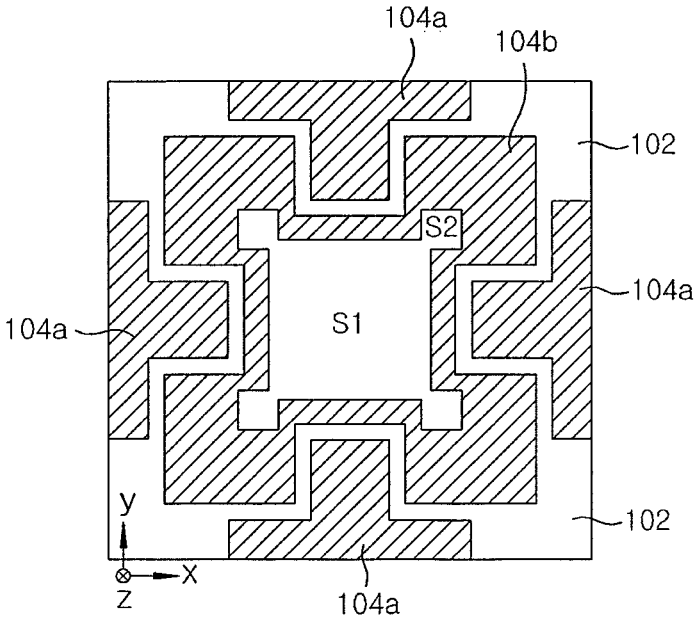
FIG. 7 shows a unit cell pattern in accordance with another embodiment of the present invention.

FIG. 7 shows a unit cell pattern in accordance with other embodiment of the present invention. The embodiment of this unit cell is made by modifying the unit cell pattern structure shown in FIGS. 5A and 5B in order to widen the absorption band and set a higher absorption frequency.

As shown in FIG. 7, the unit cell pattern includes a basic patch 104*b*' located in the center of the unit cell pattern. The shape of the basic patch 104*b*' is a quadrangle whose center of each side is cut by a quadrangle. The first slot S1 of a quadrangle structure is formed on the center of the basic patch 104*b*' and the second slot S2 of a quadrangle structure is formed in each corner of the first slot S1 on the basic patch 104*b*'. In addition, the unit cell pattern includes a semi-orthogonal dipole patch 104*a*'. The semi-orthogonal dipole patch 104*a*' is arranged to be engaged in each center of the upper side, the bottom side, the left side, the right side of the basic patch 104*b*' at a predetermined gap and angle. Alternatively, the second slot S2 may not be formed.

The resonance frequency and the absorption band of the electromagnetic wave absorbing apparatus may be adjusted by controlling at least one of factors such as a structure parameter determining the electrical distance between the basic patch 104*b*' and the semi-orthogonal dipole patch 104*a*', a spacing between the basic patch 104*b*' and the semi-orthogonal dipole patch 104*a*', a height from the metal conductor layer to the unit cell pattern, the material characteristic of the dielectric layer, the surface resistance of the unit cell pattern, the size of the first slot and the length of the one side of the second slot. In an exemplary alternative embodiment where the second slot S2 is not formed, the resonance frequency and the absorption band of the electromagnetic wave absorbing apparatus may be adjusted by controlling at least one of the factors except the length of the one side of the second slot.

Figure 8:
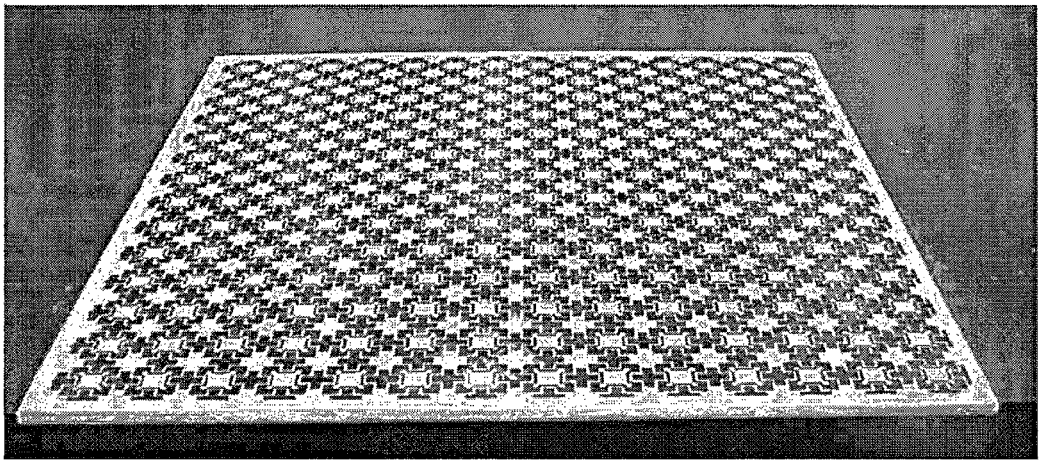
FIG. 8 shows an electromagnetic wave absorbing apparatus manufactured by arranging periodically the unit cell pattern shown in FIG. 7.

FIG. 8 illustrates an electromagnetic wave absorbing apparatus is manufactured by arranging periodically the unit cell pattern shown in FIG. 7.

For example, in the electromagnetic wave absorbing apparatus, the unit cell patterns of the unit cells which are arranged periodically to be adjacent to each other may have a surface resistance valve different from each other. When the unit cell is arranged periodically, the unit cell patterns adjacent to each other in the unit cells arranged periodically are arranged in alternate fashion to have at least one of resistances and structures different from each other.

The unit cell patterns may be designed in any shape, e.g., a polygon such as a square and a triangle, a circle, a loop or the like, and an electromagnetic wave absorbing frequency and bandwidth can be changed in accordance with an electrical length and features of the structure.

Figure 9:
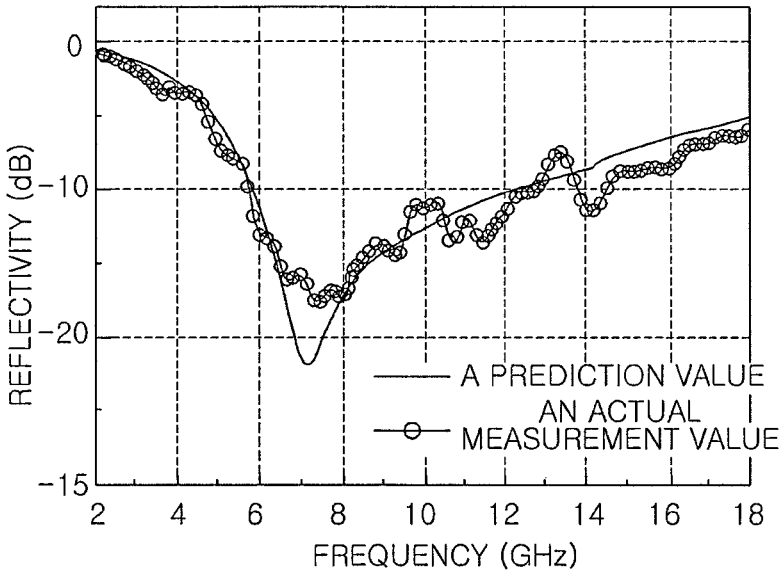
FIG. 9 depicts a graph for a predicted value and an actually measured value of an absorption performance and an absorption band of the electromagnetic wave absorbing apparatus.

FIG. 9 depicts a graph for a predicted value and an actually measured value of an absorption performance and an absorption band of the electromagnetic wave absorbing apparatus shown in FIG. 8.

It is confirmed that the designed electromagnetic wave absorbing apparatus operates actually very similarly to the prediction. In addition, a maximum absorption frequency is raised compared with a prediction result from the unit cell pattern shown in FIGS. 5A and 5B and the absorption band is widen accordingly. The maximum absorption frequency is 7

GHz and a wavelength is about 43 mm. The thickness of the electromagnetic wave absorbing apparatus is about λ/10 and the thickness of the electromagnetic wave absorbing becomes much thinner than the thickness of the conventional electromagnetic wave absorber, i.e., λ/4.

In addition, when it is considered that the conventional electromagnetic wave absorber having the absorption rate of about −3~5 dB is commercialized, the electromagnetic wave absorbing apparatus of the embodiments may be manufactured to be much thinner at the absorption rate level of about −22 dB.

Figure 10:
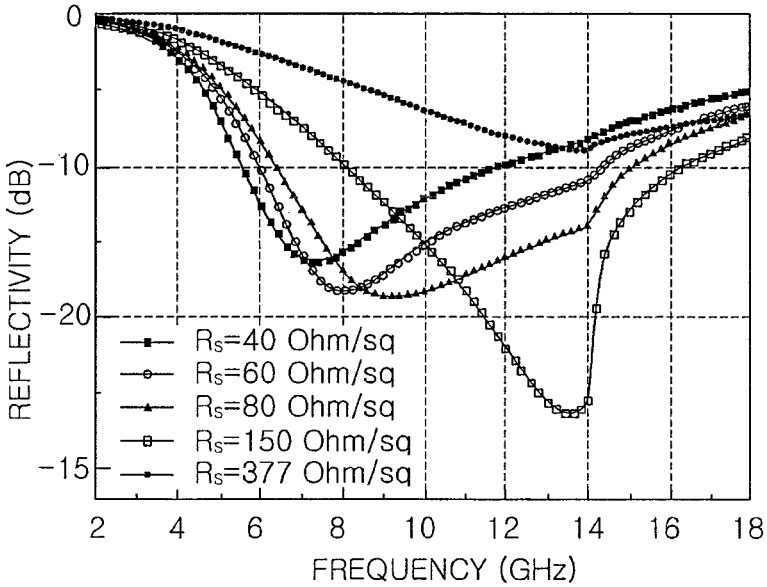
FIG. 10 shows an absorption performance result simulated by changing a surface resistance of a unit cell pattern in the electromagnetic wave absorbing apparatus.

FIG. 10 shows an absorption performance result simulated by changing the surface resistance Rs of the unit cell pattern of the electromagnetic wave absorbing apparatus shown in FIG. 8.

As can be seen from FIG. 10, the maximum absorption frequency and the absorption band may be adjusted by changing the surface resistance Rs.

Figure 11:
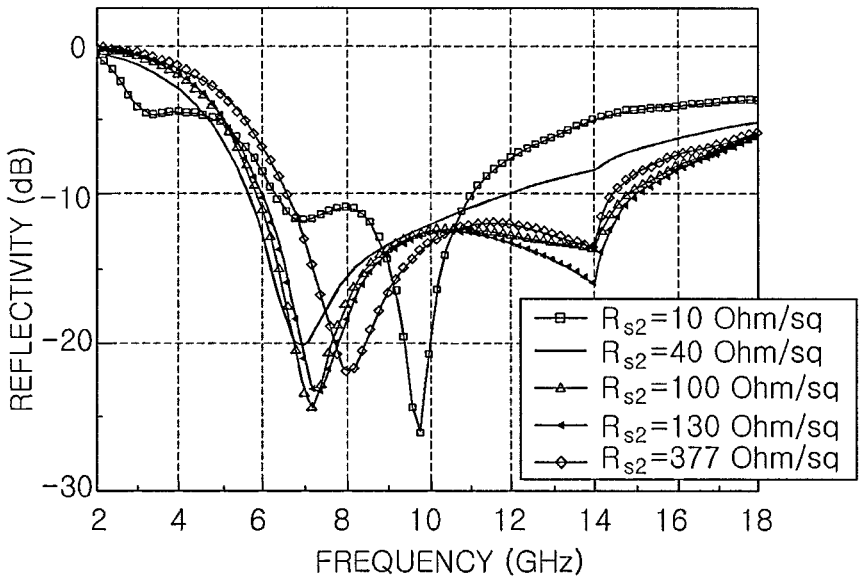
FIG. 11 illustrates a graph for a performance of an electromagnetic absorbing apparatus which is calculated while changing a surface resistance of a basic patch when a value of a surface resistance of a semi-orthogonal dipole patch is fixed to have a conventional design value in the unit cell pattern shown in FIG. 7.

FIG. 11 illustrates the performance change of the electromagnetic absorbing apparatus which is calculated by changing the surface resistance $R_{s2}$ of the basic patch 104*b*' when the surface resistance $R_{s1}$ of the semi-orthogonal dipole patch 104*a*' is fixed to have 40 Ohm/sq in the unit cell pattern shown in FIG. 7.

As known from FIG. 11, as hybrid structure, the absorption bandwidth is enhanced when $R_{s2}$ is larger than 40 Ohm/sq.

Figure 12:
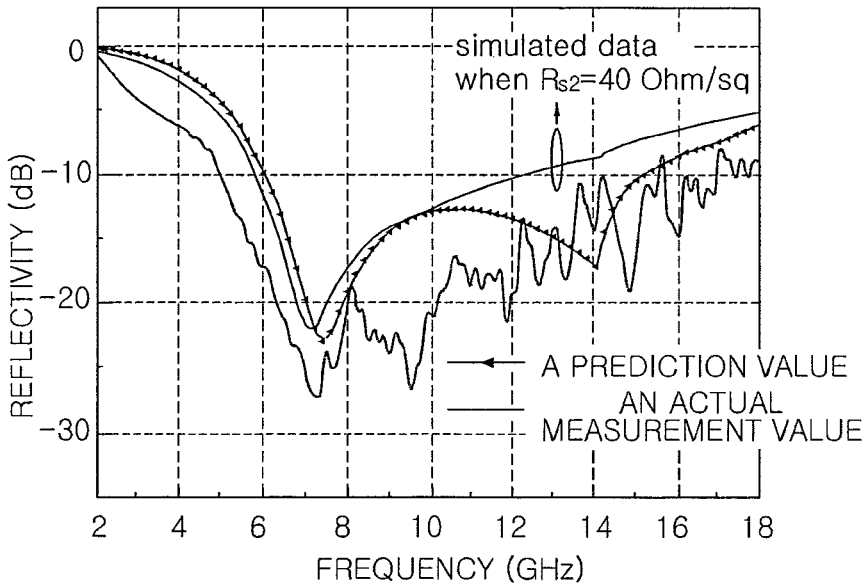
FIG. 12 shows a graph of comparison between a predicted value and an actually measured value obtained by manufacturing an electromagnetic wave absorbing apparatus and performing a measurement when a surface resistance of the basic patch has a specified value under the same condition as in FIG. 7.

FIG. 12 shows a graph of comparison between a predicted value and an actually measured value measured by using a manufactured electromagnetic wave absorbing apparatus when the surface resistance of the basic patch in FIG. 12 is 40 Ohm/sq.

Referring to FIG. 12, the performance is improved as estimated in the graph shown in FIG. 11. The measurement result shows that the performance improvement exceeds the calculation result.

As described above, the electromagnetic wave absorbing apparatus included in the electromagnetic wave reverberation chamber in accordance with the embodiments of the present invention can be manufactured to be thinner than the conventional electromagnetic wave absorbers. In addition, the absorption performance (the absorption band and the maximum absorption frequency) of the electromagnetic wave absorbing apparatus can be easily adjusted by simply modifying the physical parameter and the electrical parameter of the unit cell structure. The unit cell structures having the absorption performance by the design process are a basic unit cell structure of the electromagnetic wave absorbing apparatus based on the periodic structure according to the embodiments of the present invention and the unit cell structures can absorb selectively frequencies in the different frequency bands.

Meanwhile, in the embodiments, the electromagnetic wave absorbing apparatus may be manufactured in the form of a film roll screen.

Figure 13:
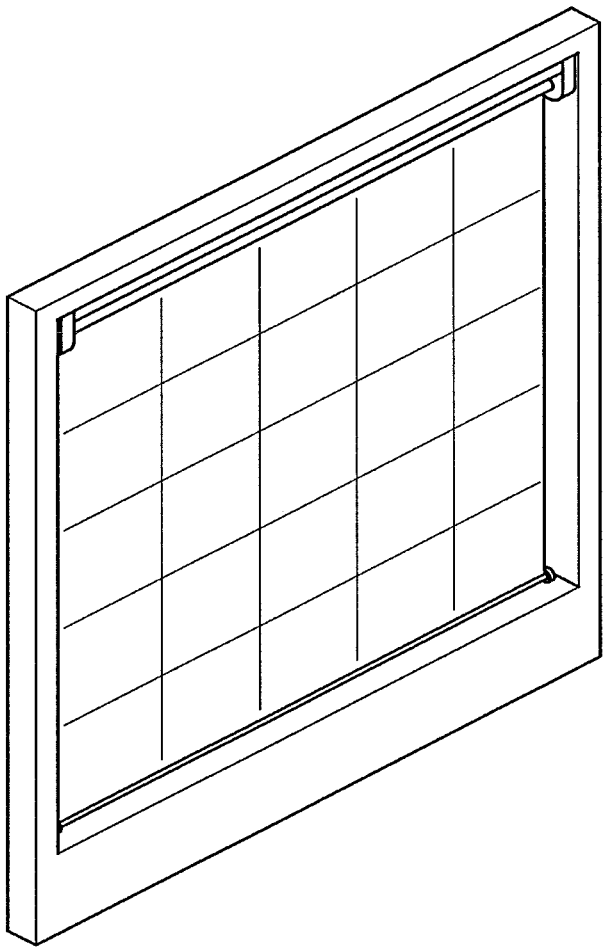
FIG. 13 shows a roll screen that is applicable to an electromagnetic wave absorbing structure in accordance with an embodiment of the present invention.

FIG. 13 shows a roll screen that is applicable to an electromagnetic wave absorbing apparatus in accordance with an embodiment of the present invention, wherein the roll screen is fixed to the upper end of the wall so that its length can be adjusted downward.

Figure 14:
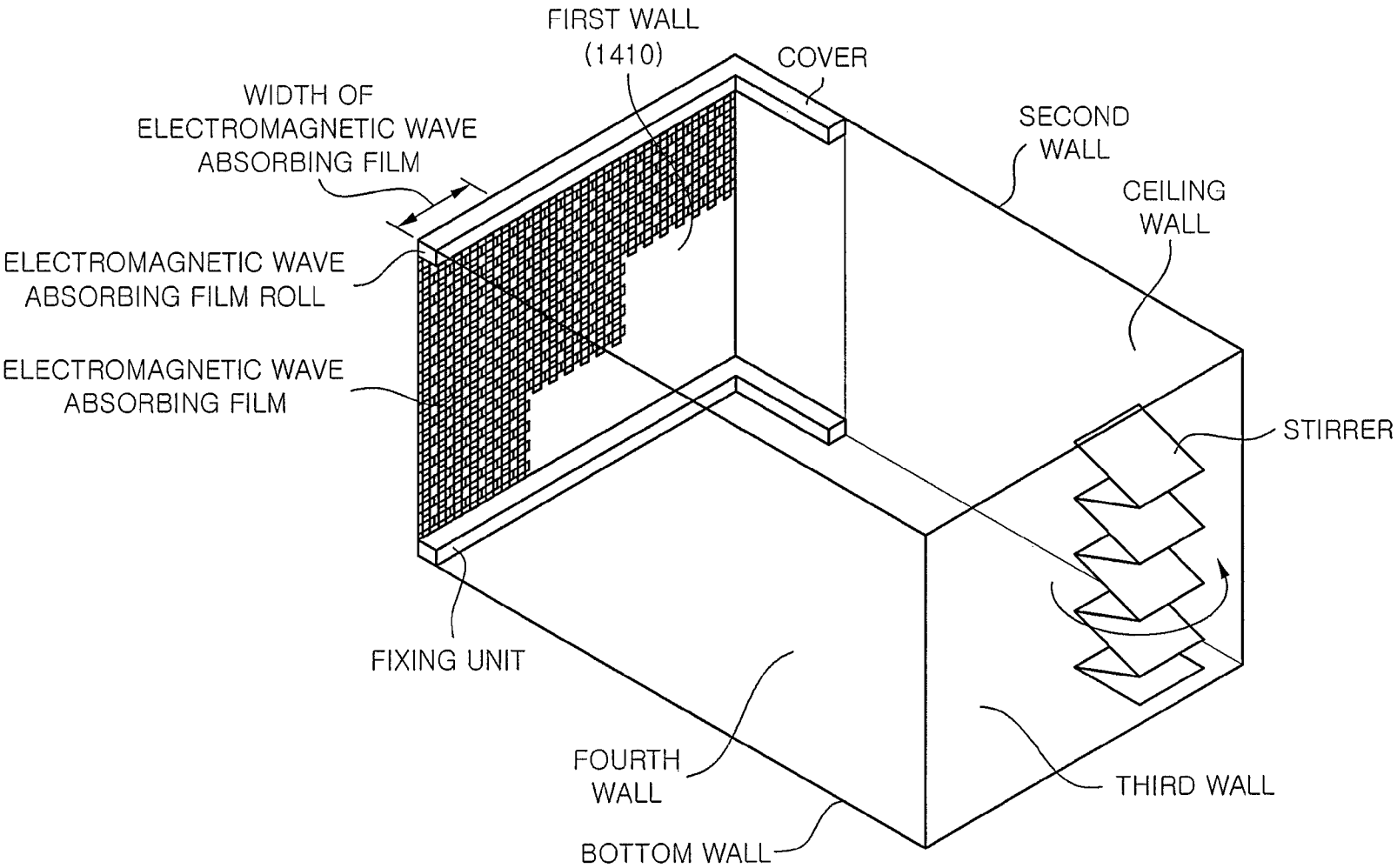
FIG. 14 shows a state in which an electromagnetic wave absorbing film manufactured in the form of a roll screen shown in FIG. 13 is installed at an upper end of a first inner wall of a rectangular parallelepiped electromagnetic wave reverberation chamber.

FIG. 14 shows an electromagnetic wave absorbing film obtained by screen-printing an electromagnetic wave bandgap pattern layer on a transparent film such as PET film based on unit cells shown in FIG. 5 and a state in which the electromagnetic wave absorbing film manufactured in the form of a roll screen shown in FIG. 13 is installed at an upper end of the first wall inside the cube-shaped electromagnetic wave reverberation chamber.

Referring FIG. 14, an electromagnetic wave absorbing structure based on an electromagnetic wave bandgap shown in FIG. 1 is obtained by installing the electromagnetic wave absorbing films at positions separated by a predetermined gap from the metal conductor of the first wall 1410 inside the cube-shaped electromagnetic wave reverberation chamber 1400. As can be seen from the first wall, the electromagnetic wave absorbing film may be manufactured at a desired width (e.g., one or more roll screen type electromagnetic wave absorbing film rolls may be formed at the first wall 1410) so that its length from the upper end to the lower end of the wall can be partially or entirely controlled.

Further, the electromagnetic wave absorbing film roll having a different width may be installed at another wall. As such, the electromagnetic absorbing structure may include a roll screen type electromagnetic wave absorbing film, a roll having a preset width and disposed at an upper end of the first wall 1410 to roll one end of the electromagnetic wave absorbing film, a cover for covering the film roll, and a film fixing unit having the same width as that of the roll and installed at a lower end of the first wall to fix the other end of the electromagnetic wave absorbing film.

By installing the electromagnetic wave film roll at the inner wall of the electromagnetic wave reverberation chamber which is made of a metal conductor, the width and the length may be varied, and the inner reflection environment may be easily and freely controlled. Further, since the electromagnetic wave absorbing apparatus may be easily detached when unnecessary, the performance of the electromagnetic wave reverberation chamber can be maintained.

The electromagnetic wave reverberation chamber in accordance with the embodiments of the present invention provides at least one of the following effects.

In the electromagnetic wave reverberation chamber in accordance with the present embodiment of the present invention, the electromagnetic wave absorbing structure to which the periodic structure technology such as electromagnetic bandgap is applied is manufactured in the form of a roll screen and applied to the electromagnetic wave reverberation chamber. Thus, the electromagnetic wave absorbing structure of a desired size can be easily installed at a position desired by a user, and the electromagnetic wave reflection characteristics in the electromagnetic wave reverberation chamber can be variously controlled.

In other words, such configuration provides the effect in which the communication environment can be controlled between line of sight and non-line of sight for communication in the electromagnetic wave reverberation chamber. This indicates that a RMS (root mean square) delay spread and a K-factor can be controlled. Moreover, the electromagnetic wave reflection characteristics in the electromagnetic wave reverberation chamber can be improved compared to the conventional material-based absorbers. The intensity of the electromagnetic wave in the entire reverberation chamber can be uniform, and the propagating directions of the electromagnetic wave can be uniform in all directions. Furthermore, due to a small size of the electromagnetic wave absorbing apparatus, the inner space of the electromagnetic wave reverberation chamber that can be utilized can be expanded.

Accordingly, a user may utilize a larger inner space of the electromagnetic wave reverberation chamber, and test devices of various sizes can be tested. Further, since a smaller space is required for the same test devices, the manufacturing cost of the electromagnetic wave reverberation chamber may be considerably reduced.

While the invention has been shown and described with respect to the embodiments, the present invention is not limited thereto. It will be understood by those skilled in the art that various changes and modification may be made without departing from the scope of the invention as defined in the following claims.

What is claimed is:

1. An electromagnetic wave reverberation chamber comprising:

a plurality of walls formed in the shape of a polyhedron, each wall of the electromagnetic wave reverberation chamber being made of a metal conductor, and an electromagnetic wave absorbing apparatus which is installed on at least one wall of the metal conductors of the electromagnetic wave reverberation chamber, the electromagnetic wave absorbing apparatus comprising one or more roll screen type electromagnetic wave absorbing film rolls allowing the length of the electromagnetic wave absorbing apparatus installed on the at least one wall to be controlled.

2. An electromagnetic wave reverberation chamber comprising:

a plurality of walls formed in the shape of a polyhedron, each wall of the electromagnetic wave reverberation chamber being made of a metal conductor, and an electromagnetic wave absorbing apparatus which is installed on at least one wall of the metal conductors of the electromagnetic wave reverberation chamber, the electromagnetic wave absorbing apparatus having a shape of a roll screen, wherein the electromagnetic wave absorbing apparatus includes:

an electromagnetic wave absorbing film;

a roll for rolling the one end of the electromagnetic wave absorbing film;

a cover for covering the roll; and a fixing unit for fixing the other end of the electromagnetic wave absorbing film.

3. The electromagnetic wave reverberation chamber of claim 2, wherein the electromagnetic wave absorbing film is formed by screen-printing the electromagnetic wave bandgap pattern layer on a transparent film.

4. The electromagnetic wave reverberation chamber of claim 3, wherein the transparent film is made of PET (Poly Ethylene Terephthalate).

5. An electromagnetic wave reverberation chamber comprising:

a plurality of walls formed in the shape of a polyhedron, each wall of the electromagnetic wave reverberation chamber being made of a metal conductor, and an electromagnetic wave absorbing apparatus which is installed on at least one wall of the metal conductors of the electromagnetic wave reverberation chamber, the electromagnetic wave absorbing apparatus having a shape of a roll screen, wherein the electromagnetic wave absorbing apparatus includes a plurality of unit cells arranged periodically, wherein each of the unit cell includes:

a metal conductor layer;

a dielectric layer formed on the metal conductor layer; and a unit cell pattern formed on the dielectric layer, the unit cell pattern being made of a resistive material.

6. The electromagnetic wave reverberation chamber of claim 5, wherein the electromagnetic wave absorbing apparatus includes a plurality of unit cells arranged periodically, wherein each of the unit cells includes a metal conductor layer;

a dielectric layer formed on the metal conductor layer;

a unit cell pattern formed on the dielectric layer, the unit cell pattern being made of a resistive material; and a resistive film formed on the unit cell pattern.

7. The electromagnetic wave reverberation chamber of claim 5, wherein the unit cell pattern has at least one shape of polygon, circle and loop.

8. The electromagnetic wave reverberation chamber of claim 6, wherein the unit cell pattern has at least one shape of polygon, circle and loop.

9. The electromagnetic wave reverberation chamber of claim 5, wherein the unit cell patterns adjacent to each other in the unit cells arranged periodically have with a different surface resistance value.

10. The electromagnetic wave reverberation chamber of claim 5, wherein the unit cell patterns adjacent to each other in the unit cells arranged periodically are arranged in alternate fashion to have at least one of resistances and structures different from each other.

11. The electromagnetic wave reverberation chamber of claim 5, wherein the unit cell pattern includes:

a basic patch which is located in a center of the unit cell pattern, the basic patch having a quadrangle shape whose center of each side is cut by a quadrangle; and a semi-orthogonal dipole patch arranged to be engaged in each center of an upper side, a bottom side, a left side and a right side of the basic patch at a predetermined gap and angle.

12. The electromagnetic wave reverberation chamber of claim 11, wherein a resonance frequency and a band of the electromagnetic wave absorbing apparatus are controlled by adjusting at least one of a structure parameter determining an electrical distance between the basic patch and the semi-orthogonal dipole patch, a spacing between the basic patch and the semi-orthogonal dipole patch, a height from the metal conductor layer to the unit cell pattern, a material characteristic of the dielectric layer, and a surface resistance of the unit cell pattern.

13. The electromagnetic wave reverberation chamber of claim 11, wherein the basic patch includes a first slot of a quadrangle formed in a center thereof.

14. The electromagnetic wave reverberation chamber of claim 13, wherein a resonance frequency and a band of the electromagnetic wave absorbing apparatus are controlled by adjusting at least one of a structure parameter determining an electrical distance between the basic patch and the semi-orthogonal dipole patch, a spacing between the basic patch and the semi-orthogonal dipole patch, a height from the metal conductor layer to the unit cell pattern, a material characteristic of the dielectric layer, a surface resistance of the unit cell pattern, and a size of the first slot.

15. The electromagnetic wave reverberation chamber of claim 13, wherein the basic patch includes a second slot of a quadrangle formed in each corner of the first slot on the basic patch.

16. The electromagnetic wave reverberation chamber of claim 15, wherein a resonance frequency and a band of the electromagnetic wave absorbing apparatus are controlled by adjusting at least one of a structure parameter determining an electrical distance between the basic patch and the semi-orthogonal dipole patch, a spacing between the basic patch and the semi-orthogonal dipole patch, a height from the metal conductor layer to the unit cell pattern, a material characteristic of the dielectric layer, a surface resistance of the unit cell pattern, a size of the first slot, and length of one side of the second slot.

17. The electromagnetic wave reverberation chamber of claim 11, wherein the basic patch and the semi-orthogonal dipole patch have a different surface resistance value.

18. The electromagnetic wave reverberation chamber of claim 12, wherein the structure parameter includes at least one of a length of one side of the unit cell pattern, a length of a side of the semi-orthogonal dipole patch coming into contact with the unit cell pattern, a length of a side parallel to the basic patch among sides of the semi-orthogonal dipole patch being coupled with the basic patch, a length of the one side of the quadrangle of the basic patch, a thickness of the unit cell, and a height perpendicular to the one side of the unit cell pattern in the semi-orthogonal dipole patch.

19. The electromagnetic wave reverberation chamber of claim 14, wherein the structure parameter includes at least one of a length of one side of the unit cell pattern, a length of a side of the semi-orthogonal dipole patch coming into contact with the unit cell pattern, a length of a side parallel to the basic patch among sides of the semi-orthogonal dipole patch being coupled with the basic patch, a length of the one side of the quadrangle of the basic patch, a thickness of the unit cell, and a height perpendicular to the one side of the unit cell pattern in the semi-orthogonal dipole patch.

20. The electromagnetic wave reverberation chamber of claim 16, wherein the structure parameter includes at least one of a length of one side of the unit cell pattern, a length of a side of the semi-orthogonal dipole patch coming into contact with the unit cell pattern, a length of a side parallel to the basic patch among sides of the semi-orthogonal dipole patch being coupled with the basic patch, a length of the one side of the quadrangle of the basic patch, a thickness of the unit cell, and a height perpendicular to the one side of the unit cell pattern in the semi-orthogonal dipole patch.

* * * * *